US009970454B2

(12) United States Patent
Tadokoro et al.

(10) Patent No.: US 9,970,454 B2
(45) Date of Patent: May 15, 2018

(54) PROPELLER FAN, BLOWER DEVICE, AND OUTDOOR EQUIPMENT

(71) Applicant: Mitsubishi Electric Corporation, Tokyo (JP)

(72) Inventors: Takahide Tadokoro, Tokyo (JP); Yasuaki Kato, Tokyo (JP); Atsushi Kono, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 335 days.

(21) Appl. No.: 14/776,902

(22) PCT Filed: Jan. 20, 2014

(86) PCT No.: PCT/JP2014/050948
§ 371 (c)(1),
(2) Date: Sep. 15, 2015

(87) PCT Pub. No.: WO2014/162758
PCT Pub. Date: Oct. 9, 2014

(65) Prior Publication Data

US 2016/0025101 A1 Jan. 28, 2016

(30) Foreign Application Priority Data

Apr. 4, 2013 (WO) ..... PCT/JP2013/060295

(51) Int. Cl.
*F04D 29/32* (2006.01)
*F04D 19/00* (2006.01)
(Continued)

(52) U.S. Cl.
CPC ..... *F04D 29/329* (2013.01); *F04D 19/002* (2013.01); *F04D 25/08* (2013.01);
(Continued)

(58) Field of Classification Search
CPC .... F04D 29/329; F04D 29/384; F04D 29/666; F04D 29/667; F04D 29/681;
(Continued)

(56) References Cited

U.S. PATENT DOCUMENTS 1,467,725 A * 9/1923 Higgs ..... B63H 1/15 416/212 R
2008/0253896 A1* 10/2008 Walls ..... F04D 19/005 416/223 R
2011/0200445 A1* 8/2011 Takeda ..... F04D 29/38 416/223 R

FOREIGN PATENT DOCUMENTS

CN 1321838 A 11/2001
CN 202833301 U * 3/2013 ..... F04D 29/32
(Continued)

OTHER PUBLICATIONS

Extended European Search Report dated Oct. 24, 2016 in the corresponding EP application No. 14778652.9.
(Continued)

*Primary Examiner* — Ninh H Nguyen
*Assistant Examiner* — Topaz L Elliott
(74) *Attorney, Agent, or Firm* — Posz Law Group, PLC

(57) ABSTRACT

A propeller fan, including: a boss; and a plurality of blades, each of the plurality of blades including a pressure surface and a suction surface, in which: when a connecting portion between the pressure surface and a side surface of the boss is defined as a pressure surface-side boundary portion, and a connecting portion between the suction surface and the side surface of the boss is defined as a suction surface-side boundary portion, a curvature of the suction surface-side boundary portion is smaller than a curvature of the pressure surface-side boundary portion; and as a blade area projected
(Continued)

on a plane orthogonal to the rotation axis, a blade area of the suction surface is larger than a blade area of the pressure surface.

8 Claims, 12 Drawing Sheets

(51) Int. Cl.
*F04D 29/66* (2006.01)
*F04D 25/08* (2006.01)
*F04D 29/68* (2006.01)
*F04D 29/38* (2006.01)

(52) U.S. Cl.
CPC ..... *F04D 29/384* (2013.01); *F04D 29/667* (2013.01); *F04D 29/681* (2013.01); *F04D 29/666* (2013.01); *F05D 2240/306* (2013.01)

(58) Field of Classification Search
CPC ..... F04D 19/002; F04D 25/064; F04D 25/08; F04D 29/32; B63H 1/20
USPC ..... 416/234
See application file for complete search history.

(56) References Cited

FOREIGN PATENT DOCUMENTS

| | | | | | |
|---|---|---|---|---|---|
| FR | 351725 | A | * | 7/1905 | ..... B63H 1/20 |
| JP | S60-073000 | U | | 5/1985 | |
| JP | H01-110898 | A | | 4/1989 | |
| JP | H05-079496 | A | | 3/1993 | |
| JP | H11-294389 | A | | 10/1999 | |
| JP | 2000-002197 | A | | 1/2000 | |
| JP | 2000002197 | A | * | 1/2000 | |
| JP | 2000-136797 | A | | 5/2000 | |
| JP | 2000-320493 | A | | 11/2000 | |

OTHER PUBLICATIONS

Office Action dated Oct. 8, 2016 issued in corresponding CN patent application No. 201480019899.X (and English translation).
International Search Report of the International Searching Authority dated Mar. 11, 2014 for the corresponding international application No. PCT/JP2014/050948 (and English translation).

* cited by examiner

201

PROPELLER FAN, BLOWER DEVICE, AND OUTDOOR EQUIPMENT

CROSS REFERENCE TO RELATED APPLICATION

This application is a U.S. national stage application of PCT/JP2014/050948 filed on Jan. 20, 2014, which claims priority to International Application No. PCT/JP2013/060295 filed on Apr. 4, 2013, the contents of which are incorporated herein by reference.

TECHNICAL FIELD

The present invention relates to a propeller fan, an air blower, and an outdoor unit.

BACKGROUND ART

Nowadays, various blade shapes are proposed in order to achieve a low-noise and high-efficient air blower. In general, in order to achieve the low noise and the high efficiency of a fan, it is required to suppress fluctuation in pressure acting on the blades and reduce frictional loss between air streams by reducing turbulence of the air streams to be generated around the blades.

For example, in Patent Literature 1, there is disclosed a propeller fan in which aside surface of a boss having a plurality of blades mounted thereon is formed into a conical shape. In this propeller fan, as a radial cross-sectional shape of each of the blades, an outer side of a radial midpoint thereof has a concave curved line with respect to a windward side, and the outer side of the radial midpoint has a convex curved line with respect to the windward side. With such a configuration, a leakage vortex at a blade tip is stabilized to cause a smooth radial inflow in a high load region so that a static pressure is enhanced.

CITATION LIST

Patent Literature

[PTL 1] JP 11-294389 A (FIG. 4)

SUMMARY OF INVENTION

Technical Problem

When air velocity distribution and static pressure distribution are increased after the flow passes along a blade surface, a flow in a direction different from an intended flowing direction (secondary flow) is generated. The secondary flow may cause an insufficient air flow rate, and may increase the noise and reduce the efficiency by generating the vortex.

In the flow along the blade surface or the flow between the blades, a difference of the static pressure distribution and a difference of the air velocity distribution may occur. For example, assuming that a surface in which a normal to the blade surface is oriented to a rotating direction at the time of blowing the air is a pressure surface (surface that pushes the air stream at the time of rotation), and a surface in which the normal to the blade surface is oriented to a direction opposite to the rotating direction is a suction surface (surface that does not push the air stream), the static pressure difference occurs between the pressure surface and the suction surface.

Further, on an outer peripheral side of the blade on the suction surface side, a blade tip vortex is generated when the air stream flowing along the pressure surface leaks to the suction surface due to a centrifugal force. With this, the static pressure on the suction surface is reduced. Therefore, the static pressure of the flow, which passes around the leakage vortex of the suction surface to be blown out of an outer peripheral portion, is significantly reduced.

Further, the blade tip vortex is an obstacle to the air stream passage. Thus, the area (effective area) of the suction surface in which the air stream passes to attain a pressure rise effect is reduced compared to that of the pressure surface, and the static pressure difference at a trailing edge portion at which the air stream passing along the pressure surface and the air stream passing along the suction surface join each other is increased.

Further, when the pressure difference between the air stream on the pressure surface side and the air stream on the suction surface side at the blade trailing edge is increased and also when both the air streams join each other, the vortex and the secondary flow are developed to increase the noise and loss.

Further, the air stream subjected to pressure rise in the pressure surface is decompressed by the low-pressure air stream in the suction surface, thereby decreasing a pressure rising rate of the air between the blade leading edge and the blade trailing edge. The torque to be applied to the fan is determined by the static pressure difference occurring on the blade surfaces, and hence the torque is increased as the pressure difference is increased. Therefore, when the air stream is decompressed in the joining portion, the fan efficiency calculated based on the torque of the fan relative to the pressure rising rate is deteriorated.

Further, according to the propeller fan disclosed in Patent Literature 1, through the change of the curvatures in blade cross section, the air streams can be caused to flow smoothly to reduce the loss. However, no countermeasure is taken to reduce the pressure difference of the air streams immediately after being blown out of the blades, and hence the loss may occur due to the mixing of the air streams.

Moreover, the blades are mounted on the boss having the conical side surface, which is widened toward a downstream side. Thus, a pressure surface area of the blade is larger than a suction surface blade area. However, the side surface of the boss is an obstacle to the air stream passage, and hence the area enlarging effect may not be sufficiently obtained. Further, the area of the pressure surface is decreased as approaching the downstream side, and hence a blow-out region of the fan on an inner peripheral side is decreased. Thus, the air flow rate may also be decreased.

Moreover, when the blade tip leakage vortex is stabilized, a low-pressure portion generated in the suction surface is intensified. Thus, there is a problem in that the pressure difference between the air stream flowing along the pressure surface and the air stream flowing along the suction surface is increased.

The present invention has been made in view of the above-mentioned circumstances, and has an object to provide a propeller fan capable of achieving low noise by suppressing a secondary flow through reduction in static pressure difference between a pressure surface and a suction surface on a blow-out side of blades, that is, in the vicinity of a trailing edge, and also achieving high efficiency of the fan by preventing decrease in pressure rising rate, which is caused by joining an air stream on the pressure surface and an air stream on the suction surface at the trailing edge portion.

Solution to Problem

In order to achieve the object described above, according to one embodiment of the present invention, there is provided a propeller fan, including: a boss provided so as to be rotatable about a rotation axis; and a plurality of blades formed along a side surface of the boss, each of the plurality of blades including a pressure surface and a suction surface, in which: when a connecting portion between the pressure surface of the each of the blades and the side surface of the boss is defined as a pressure surface-side boundary portion, and a connecting portion between the suction surface of the each of the blades and the side surface of the boss is defined as a suction surface-side boundary portion, a curvature of the suction surface-side boundary portion is smaller than a curvature of the pressure surface-side boundary portion; and as a blade area projected on a plane orthogonal to the rotation axis, a blade area of the suction surface is larger than a blade area of the pressure surface.

A radius of a leading end portion of the suction surface-side boundary portion may be smaller than a radius of a leading end portion of the pressure surface-side boundary portion.

A radius of a trailing end portion of the suction surface-side boundary portion may be larger than the radius of the leading end portion of the suction surface-side boundary portion.

The radius of the trailing end portion of the suction surface-side boundary portion may be equal to a radius of a trailing end portion of the pressure surface-side boundary portion.

The radius of the suction surface-side boundary portion may be enlarged smoothly as being shifted from the leading end portion to the trailing end portion of the suction surface-side boundary portion.

The pressure surface-side boundary portion may have the same radius value over a region from the leading end portion to the trailing end portion of the pressure surface-side boundary portion.

Further, in order to achieve the object, according to one embodiment of the present invention, there is provided an air blower, including: a propeller fan; a driving source for applying a driving force to the propeller fan; and a casing in which the propeller fan and the driving source are housed. The propeller fan is the above-mentioned propeller fan according to the one embodiment of the present invention.

Further, in order to achieve the object, according to one embodiment of the present invention, there is provided an outdoor unit, including: a propeller fan; a driving source for applying a driving force to the propeller fan; and a casing in which the propeller fan, the driving source, and the heat exchanger are housed. The propeller fan is the above-mentioned propeller fan according to the one embodiment of the present invention.

Advantageous Effects of Invention

According to the one embodiment of the present invention, it is possible to achieve low noise by suppressing the secondary flow through reduction in static pressure difference between the pressure surface and the suction surface, and also achieve high efficiency of the fan by preventing decrease in pressure rising rate, which is caused by joining the air stream on the pressure surface and the air stream on the suction surface at the trailing edge portion.

DESCRIPTION OF EMBODIMENTS

Figure 1:
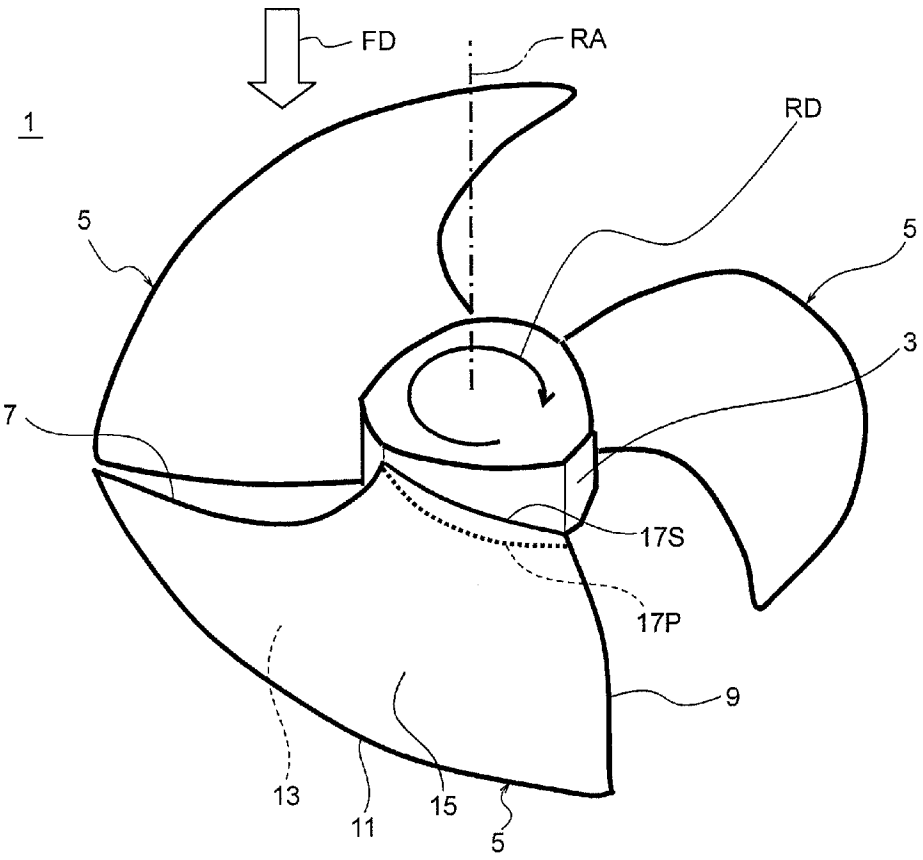
FIG. 1 is a perspective view for illustrating an overview of a propeller fan according to a first embodiment of the present invention.

Now, embodiments of the present invention are described with reference to the accompanying drawings. Note that, in the drawings, the same reference symbols represent the same or corresponding parts.

First Embodiment

FIG. 1 is a perspective view for illustrating an overview of a propeller fan according to a first embodiment of the present invention. The arrow denoted by the reference symbol RD represents a rotating direction RD of a propeller fan 1, and the arrow denoted by the reference symbol FD represents a flowing direction FD of an air stream at the time of blowing air.

The propeller fan 1 includes a boss 3 and a plurality of (three in the illustrated example) blades 5. The boss 3 is provided so as to be rotatable about a rotation axis RA. The plurality of blades 5 are formed along a side surface of the boss 3. Further, as one example, the plurality of blades 5 are formed into the same shape and arranged equiangularly. Note that, the present invention is not limited thereto, and some of the blades or each blade may have different angular intervals or shapes in arrangement.

Each of the blades 5 has a leading edge 7, a trailing edge 9, and an outer peripheral edge 11. The leading edge 7 is an edge portion on a forward side in a rotating direction of the blade 5, and the trailing edge 9 is an edge portion on a backward side in the rotating direction. The outer peripheral edge 11 is an edge portion connecting a radially outer end of the leading edge 7 and a radially outer end of the trailing edge 9.

Further, each of the blades 5 has a pressure surface 13, which is a surface that pushes the air stream at the time of rotation for blowing the air (at the time when the air stream in the flowing direction FD is generated), and a suction surface 15, which is another surface on a back side of the pressure surface 13. Further, in other words, the pressure surface 13 is such a surface that, when a blade-surface normal direction extending from the surface is decomposed into an axial component and a circumferential component, the circumferential component is oriented to the same direction as the rotating direction RD of the propeller fan 1 at the time of the rotation to blow the air. The suction surface 15 is a surface on the back thereof, specifically, the suction surface 15 is such a surface that, when the blade-surface normal direction extending from the surface is decomposed into the axial component and the circumferential component, the circumferential component is oriented to a direction opposite to the rotating direction RD of the propeller fan 1 at the time of the rotation to blow the air.

Figure 2:
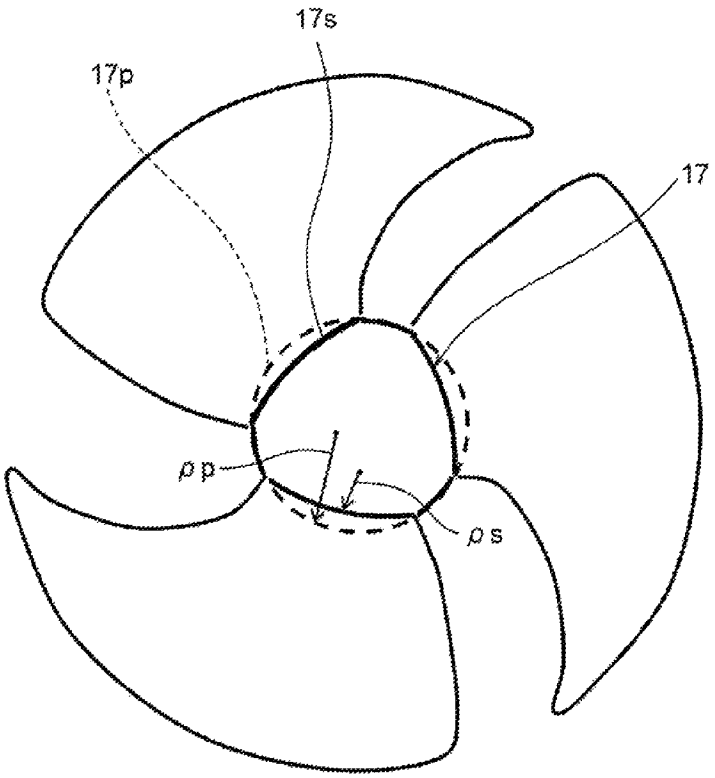
FIG. 2 is a view for illustrating the propeller fan when the propeller fan is projected on a plane orthogonal to a rotation axis thereof according to the first embodiment.

FIG. 2 is a view for illustrating the propeller fan when the propeller fan is projected on a plane orthogonal to the rotation axis according to the first embodiment. More specifically, the rotation axis RA extends orthogonally to the drawing sheet of FIG. 2, the propeller fan 1 is viewed from an upstream side in the flowing direction FD of the air stream, and the suction surface 15 is illustrated on the front side of the drawing sheet of FIG. 2.

A portion in which the side surface of the boss 3 and the blade 5 are connected to each other is referred to as a boundary portion 17. The boundary portion 17 includes a pressure surface-side boundary portion 17*p* and a suction surface-side boundary portion 17*s*. As illustrated in FIG. 2, the pressure surface-side boundary portion 17*p* is a connecting portion between the pressure surface 13 of the blade 5 and the side surface of the boss 3, whereas the suction surface-side boundary portion 17*s* is a connecting portion between the suction surface 15 of the blade 5 and the side surface of the boss 3.

As best illustrated in FIG. 2, as a blade area projected on the plane orthogonal to the rotation axis, a blade area of the suction surface 15 is larger than a blade area of the pressure surface 13. Further, the pressure surface-side boundary portion 17*p* and the suction surface-side boundary portion 17*s* have different positions and curvatures (degrees of curve). The suction surface-side boundary portion 17*s* is located on a radially inner side with respect to the pressure surface-side boundary portion 17*p*, and a curve of the suction surface-side boundary portion 17*s* is smaller than a curve of the pressure surface-side boundary portion 17*p*. A curvature of the suction surface-side boundary portion 17*s* is smaller than a curvature of the pressure surface-side boundary portion 17*p*. Note that, the curvature of the suction surface-side boundary portion represents a mean value between local curvatures from a leading edge-side end portion to a trailing edge-side end potion of the suction surface-side boundary portion, whereas the curvature of the pressure surface-side boundary portion represents a mean value between local curvatures from a leading edge-side end portion to a trailing edge-side end potion of the pressure surface-side boundary portion (the same holds true also in the following second to sixth embodiments). The pressure surface-side boundary portion 17*p* includes a curving region having a pressure surface-side curvature radius ρp, whereas the suction surface-side boundary portion 17*s* includes a curving region having a suction surface-side curvature radius ρs. Further, in the first embodiment, as illustrated in FIG. 2, the leading edge-side end portion and the trailing edge-side end potion of the pressure surface-side boundary portion 17*p* substantially overlap with the leading edge-side end portion and the trailing edge-side end potion of the suction surface-side boundary portion 17*s*, respectively, and the suction surface-side curvature radius ρs is larger than the pressure surface-side curvature radius ρp. Specifically, in the side surface of the boss 3, the side surface on the suction surface 15 side is closer to the rotation axis RA than the side surface on the pressure surface 13 side, in other words, a diameter of the side surface of the boss 3 on the suction surface 15 side is smaller than a diameter of the side surface of the boss 3 on the pressure surface 13 side. Moreover, in other words, the side surface of the boss 3 on the suction surface 15 side (suction surface-side boundary portion 17*s*) is recessed further toward the rotation axis RA than the side surface of the boss 3 on the pressure surface 13 side (pressure surface-side boundary portion 17*p*). Further, a contour of the boss 3 on the suction surface side is noncircular when viewed in a projected manner along the rotation axis RA.

Next, an operation of the propeller fan constructed as described above according to the first embodiment is described. The propeller fan 1 is mounted to a fan motor of an air blower and rotated by a drive force of the fan motor. Through the rotation of the propeller fan 1, the air stream flows in from the leading edge 7 of the blade 5, passes between the blades, and is discharged from the trailing edge 9. The air stream passing between the blades is changed in air stream direction due to an inclination and a camber of the blade when the air stream flows along the blade 5. With this, a static pressure thereof rises due to the change in momentum.

Figure 3:
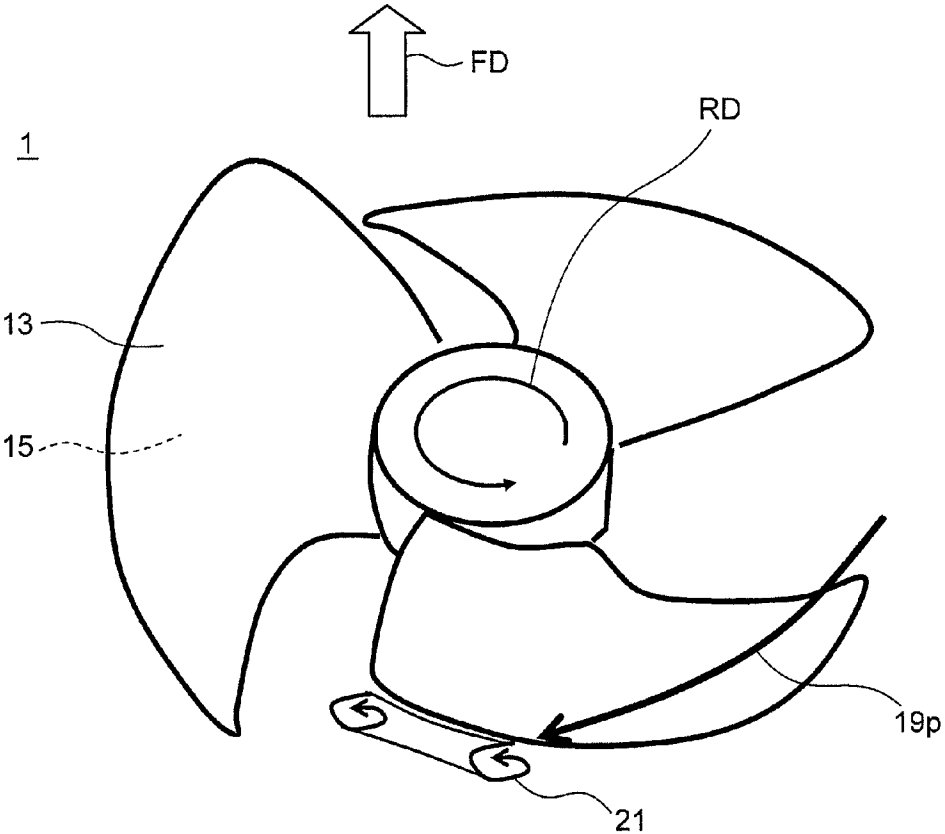
FIG. 3 is a view for schematically illustrating a flow of an air stream along a pressure surface of the propeller fan according to the first embodiment.
Figure 4:
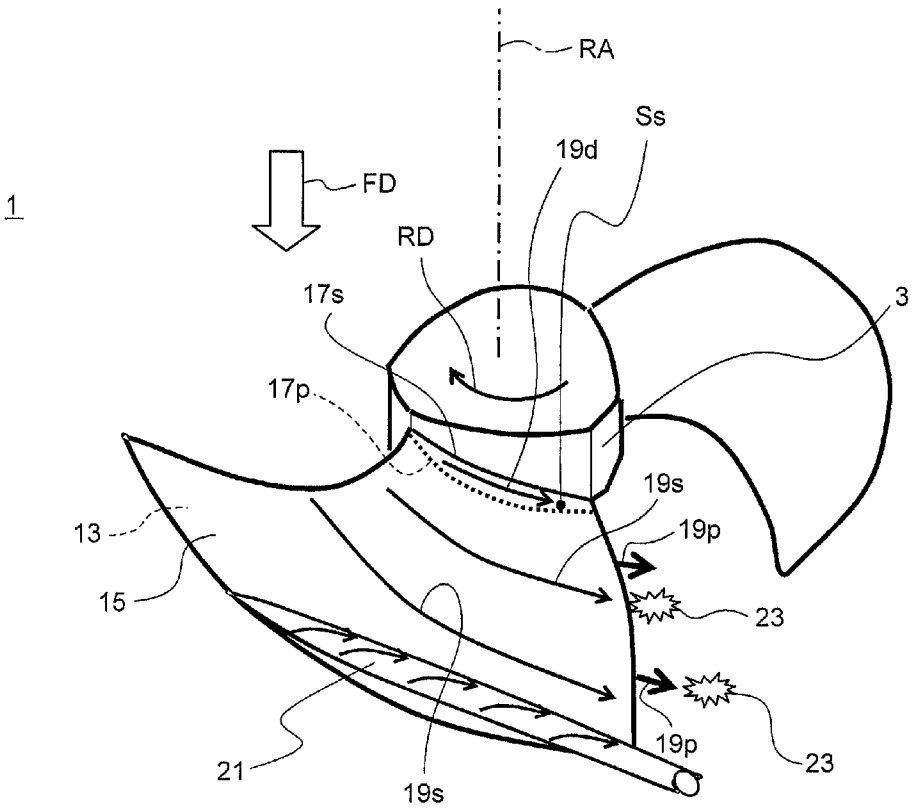
FIG. 4 is a view for schematically illustrating a flow of an air stream along a suction surface of the propeller fan according to the first embodiment.

FIG. 3 is a view for schematically illustrating a flow of the air stream along the pressure surface of the propeller fan according to the first embodiment, and FIG. 4 is a view for schematically illustrating a flow of the air stream along the suction surface of the propeller fan according to the first embodiment. Note that, FIG. 3 is illustrated reverse to FIG. 1 so that the pressure surface is illustrated on the front side of the drawing sheet. Further, in FIG. 4, for the clarity of the illustration, one of the blades is omitted from the illustration.

As illustrated in FIG. 3, an air stream 19*p* flowing along the pressure surface 13 of the blade 5 of the propeller fan 1 leaks toward the suction surface 15 while being caused to flow to an outer peripheral side of the blade 5 due to a centrifugal force. Further, as illustrated in FIG. 4, a vortex (blade tip vortex 21) is generated on the suction surface 15 due to the leakage flow.

In this case, in an existing general propeller fan, the blade tip vortex is an obstacle to the air stream passing along the suction surface (air stream 19*s* in the first embodiment of FIG. 4). A blade surface portion of the suction surface on the outer peripheral side, on which the blade tip vortex is generated, is a region that is not to be utilized for pressure rise of the air stream, thereby causing a problem in that a pressure rising rate in the suction surface is decreased.

On the other hand, in the first embodiment, as described above, the pressure surface 13 and the suction surface 15 have different curvatures at the boundary portion 17 between the boss 3 and the blade 5, and hence the suction surface-side boundary portion 17*s* is recessed further toward a center of the boss 3 than the pressure surface-side boundary portion 17*p*. Therefore, comparing the blade areas on the radially inner side (inner peripheral side) to each other, the suction surface 15 obtains an enlarging effect in the blade area on the radially inner side further than the pressure surface 13. Specifically, the blade area of the suction surface 15 is increased radially inward by an amount corresponding to a differential area Ss surrounded by the suction surface-side boundary portion 17*s* and the pressure surface-side boundary portion 17*p*. The air stream is caused to pass more easily due to the enlargement of the blade area of the suction surface 15 and the recess of the side surface of the boss 3 on the suction surface 15 side as described above. Thus, as illustrated in FIG. 4, an air stream 19*d* flowing in the region of the differential area Ss of the suction surface 15 on the boss 3 side is increased. With this, as compared to the existing general propeller fan, energy to be applied to the air stream passing along the suction surface 15 can be increased to increase the pressure rising rate of the air stream passing along the suction surface 15. As a result, a pressure difference between the air stream 19*p* having passed along the pressure surface 13 and the air stream 19*s* having passed along the suction surface 15 is decreased, thereby being capable of weakening the vortex and turbulence 23 to be generated when the air streams 19*p* and 19*s* of both the surfaces join each other at the trailing edge. Moreover, the air stream 19*p* subjected to the pressure rise in the pressure surface 13 can also be suppressed from being decompressed by the air stream 19*s* from the suction surface 15, thereby increasing the pressure rising rate relative to fan torque to enhance the efficiency.

As described above, according to the propeller fan of the first embodiment, a static pressure difference between the air stream flowing out of the pressure surface and the air stream flowing out of the suction surface at the trailing edge of the blade can be reduced, thereby being capable of weakening the vortex and turbulence to be generated at the time of joining to reduce the noise. In addition, the static pressure of the air stream subjected to the pressure rise in the pressure surface can also be suppressed from being reduced, thereby being capable of increasing the pressure rising rate relative to the fan torque also to achieve the high efficiency of the fan.

Second Embodiment

Figure 5:
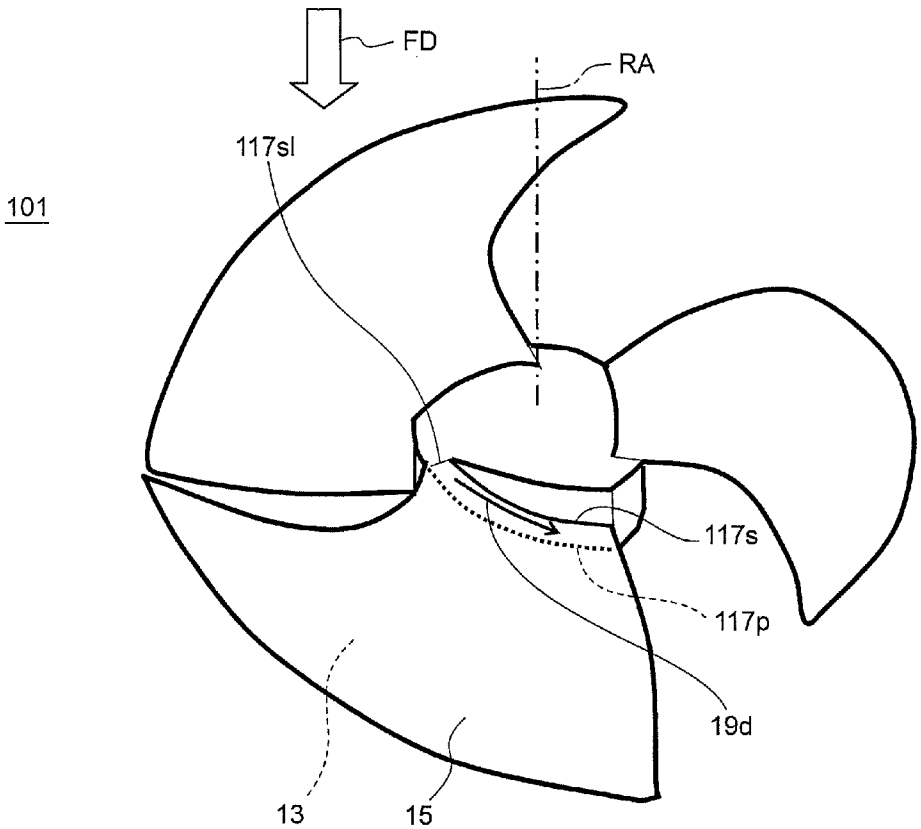
FIG. 5 is a view similar to FIG. 1, for illustrating a second embodiment of the present invention.
Figure 6:
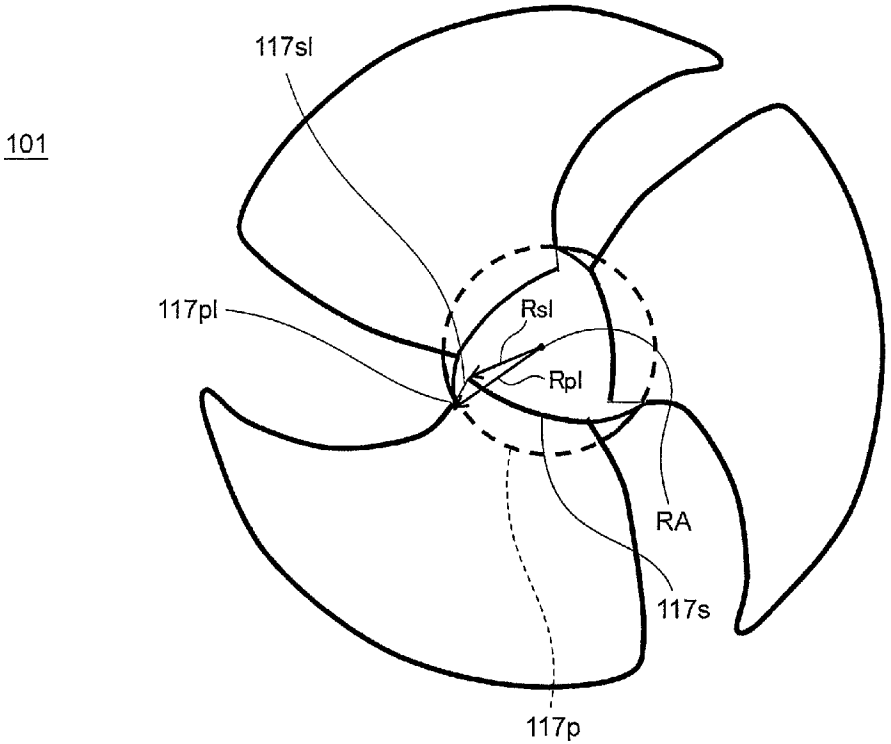
FIG. 6 is a view similar to FIG. 2, for illustrating the second embodiment.

Next, a propeller fan according to a second embodiment of the present invention is described. FIG. 5 and FIG. 6 are views similar to FIG. 1 and FIG. 2, respectively, for illustrating the second embodiment. Note that, except for the parts to be described below, the second embodiment is similar to the above-mentioned first embodiment.

A propeller fan 101 according to the second embodiment has a feature in that a radius Rsl of a leading end portion 117*sl* of a suction surface-side boundary portion 117*s* is smaller than a radius Rpl of a leading end portion 117*pl* of a pressure surface-side boundary portion 117*p*. Note that, a radius of a trailing end portion of the suction surface-side boundary portion 117*s* is also smaller than a radius of a trailing end portion of the pressure surface-side boundary portion 117*p*. Further, a curvature of the suction surface-side boundary portion 117*s* is smaller than a curvature of the pressure surface-side boundary portion 117*p*. Moreover, the contour of the boss on the suction surface side is noncircular when viewed in a projected manner along the rotation axis.

The radius Rsl is smaller than the radius Rpl as described above. With this, the blade area on the leading edge side, in particular, is enlarged to enlarge an inflow region into the blade, thereby being capable of increasing an air inflow rate of the air stream 19*d*. Through the increase in the blade area and the air flow rate, a larger amount of the air stream, which has a higher static pressure than the air stream in a region of a leakage vortex, flows along the suction surface 15. Further, such an air stream having a high static pressure flows radially outward due to the centrifugal force to be mixed with the air stream having a lower static pressure and passing around the leakage vortex, thereby increasing the static pressure of the air stream passing around the leakage vortex. As a result, the static pressure of the air stream to reach the trailing edge of the suction surface is increased. The pressure difference between the air stream on the suction surface and the air stream flowing along the pressure surface is decreased, and hence the vortex and turbulence to be generated at the time of joining can be further weakened to reduce the noise. Further, the static pressure of the air stream subjected to the pressure rise in the pressure surface can also be suppressed from being reduced, thereby increasing the pressure rising rate relative to the fan torque to enhance the efficiency.

Third Embodiment

Figure 7:
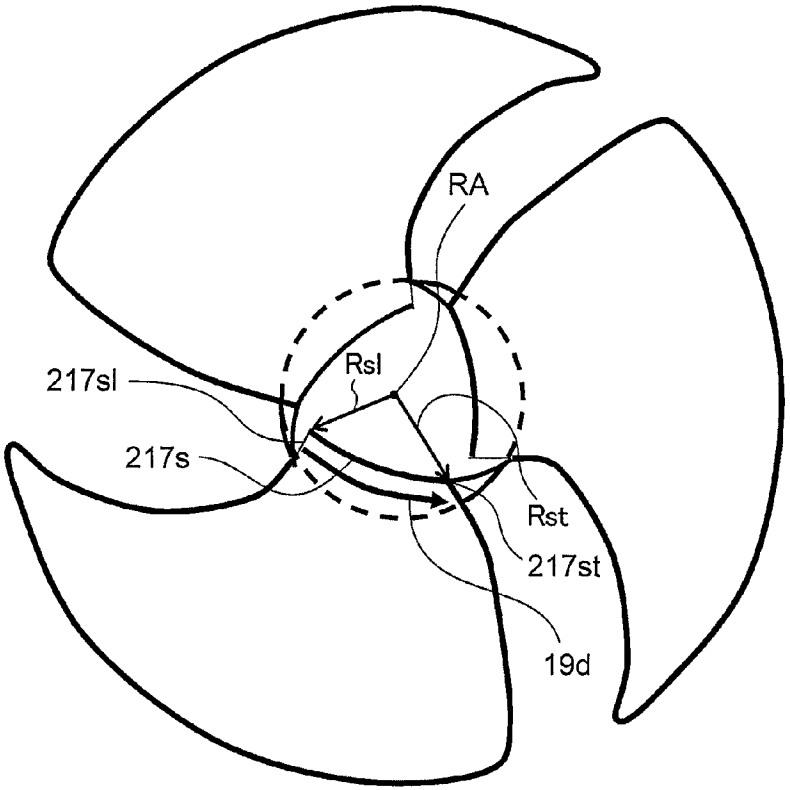
FIG. 7 is a view similar to FIG. 2, for illustrating a third embodiment of the present invention.

Next, a propeller fan according to a third embodiment of the present invention is described. FIG. 7 is a view similar to FIG. 2, for illustrating the third embodiment. Note that, except for the parts to be described below, the third embodiment is similar to the above-mentioned second embodiment.

A propeller fan 201 according to the third embodiment has a feature in that, in the above-mentioned configuration of the second embodiment, a radius Rst of a trailing end portion 217*st* of a suction surface-side boundary portion 217*s* is larger than a radius Rsl of a leading end portion 217*sl* of the suction surface-side boundary portion 217*s*. Note that, the third embodiment is similar to the second embodiment in that the curvature of the suction surface-side boundary portion is smaller than the curvature of the pressure surface-side boundary portion, and that the contour of the boss on the suction surface side is noncircular when viewed in a projected manner along the rotation axis.

In this case, in general, the air stream flowing along the blade surface flows radially outward due to the centrifugal force. Thus, the air stream flowing in from the leading edge is moved radially outward as being shifted to the trailing edge. The air stream hardly reaches the trailing edge while maintaining the same radius as that at the leading edge of the boundary portion between the blade and the boss. Therefore, the low velocity air stream is liable to stagnate at the trailing edge (trailing edge close to the boss, in particular). Due to an air velocity difference between the air stream flowing radially outward and such a low-velocity air stream, the vortex may be generated on the blade surface to reduce the static pressure of the air stream.

In view of the above, in the third embodiment, the radius Rst is larger than the radius Rsl so that the trailing end portion 217*st* of the suction surface-side boundary portion 217*s* is moved radially outward to substantially eliminate, in advance, a spot in which the low velocity air stream is liable to stagnate. With this, the region at which the vortex is liable to be generated is eliminated, and the static pressure of the air stream passing along the suction surface on the inner peripheral side is suppressed from being reduced. As a result, the pressure difference between the air stream on the suction surface and the air stream flowing along the pressure surface is further decreased, thereby being capable of further weakening the vortex and turbulence to be generated at the time of joining to reduce the noise. Further, the static pressure of the air stream subjected to the pressure rise in the pressure surface can also be suppressed from being reduced, thereby also increasing the pressure rising rate relative to the fan torque to enhance the efficiency.

Note that, the third embodiment can be implemented in combination with the above-mentioned first embodiment.

Fourth Embodiment

Figure 8:
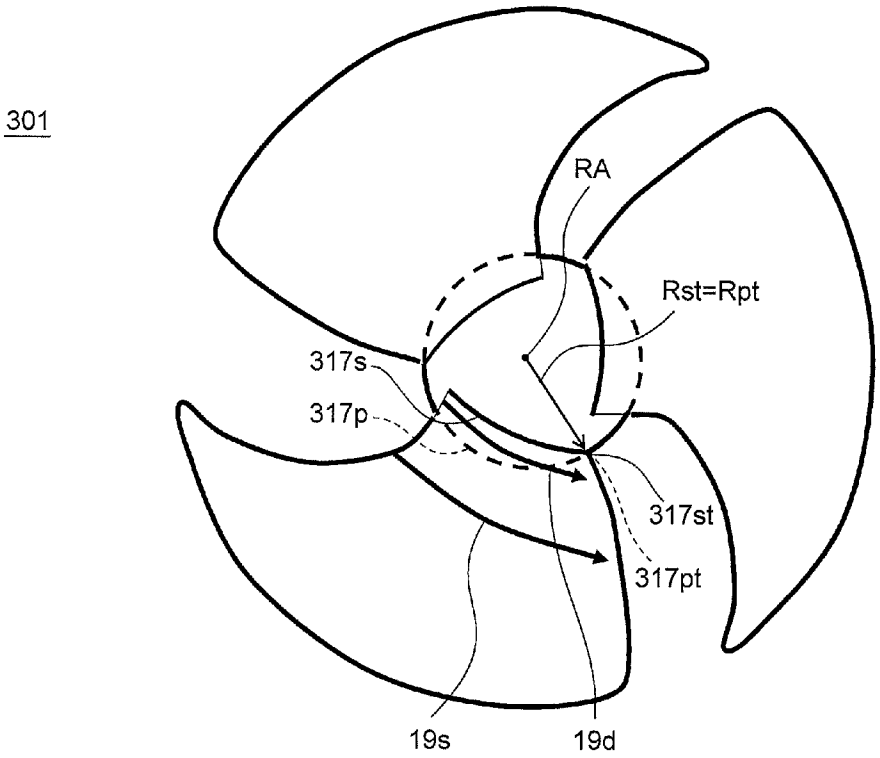
FIG. 8 is a view similar to FIG. 2, for illustrating a fourth embodiment of the present invention.

Next, a propeller fan according to a fourth embodiment of the present invention is described. FIG. 8 is a view similar to FIG. 2, for illustrating the fourth embodiment. Note that, except for the parts to be described below, the fourth embodiment is similar to the above-mentioned third embodiment.

A propeller fan 301 according to the fourth embodiment has a feature in that, in the above-mentioned configuration of the third embodiment, a radius Rst of a trailing end portion 317*st* of a suction surface-side boundary portion 317*s* is equal to a radius Rpt of a trailing end portion 317*pt* of a pressure surface-side boundary portion 317*p*. Note that, the fourth embodiment is similar to the third embodiment in that the curvature of the suction surface-side boundary portion is smaller than the curvature of the pressure surface-side boundary portion, and that the contour of the boss on the suction surface side is noncircular when viewed in a projected manner along the rotation axis.

In this case, in general, when a radius of the boundary portion between the boss and the blade in the suction surface is located on an inner side with respect to that in the pressure surface, the air stream flowing out of the boundary portion of the suction surface and the air stream on the pressure surface flowing along substantially the same radius to be joined are absent, and hence a significant velocity difference may occur at the trailing edge to generate a strong vortex. Thus, the noise and loss may be increased.

In view of the above, in the fourth embodiment, the trailing end portions of the boundary portion have the same radius between the pressure surface and the suction surface so that the air stream from the pressure surface, which is to join the air stream from the suction surface, is reliably secured. In addition to the advantage of the above-mentioned third embodiment, the fourth embodiment also has an advantage in that the vortex in the vicinity of the boundary portion can be further suppressed.

Fifth Embodiment

Figure 9:
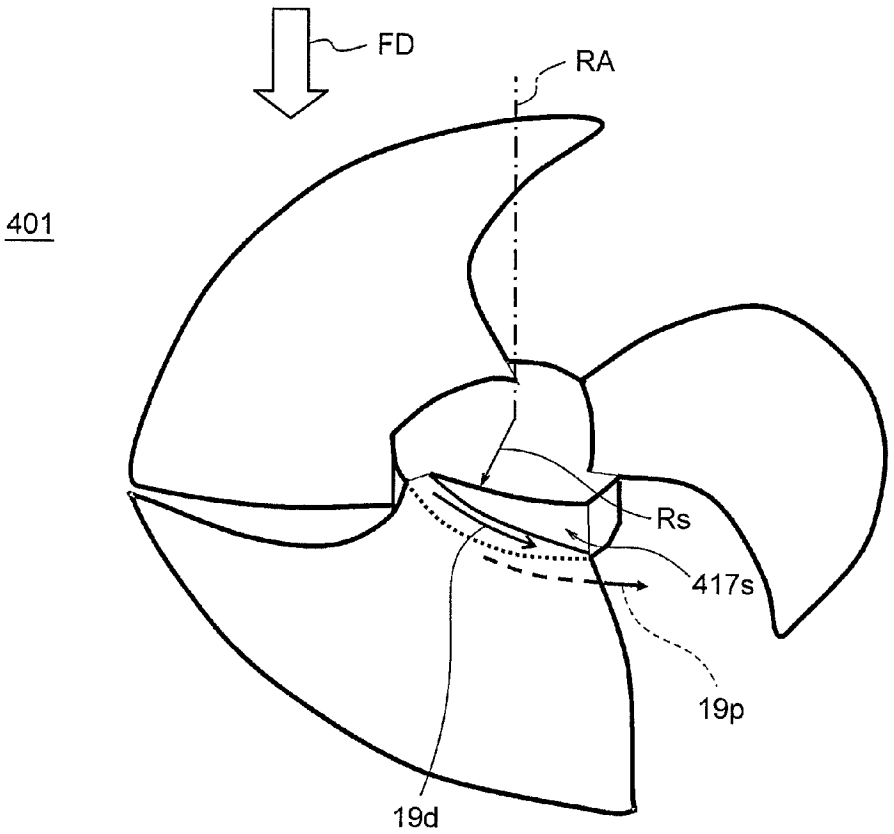
FIG. 9 is a view similar to FIG. 1, for illustrating a fifth embodiment of the present invention.

Next, a propeller fan according to a fifth embodiment of the present invention is described. FIG. 9 is a view similar to FIG. 1, for illustrating the fifth embodiment. Note that, except for the parts to be described below, the fifth embodiment is similar to the above-mentioned third embodiment.

In a propeller fan 401 according to the fifth embodiment, a radius Rs of a suction surface-side boundary portion 417*s* is enlarged gradually and changed smoothly as being shifted from the leading end portion to the trailing end portion of the suction surface-side boundary portion 417*s*. Note that, the fifth embodiment is similar to the above-mentioned embodiments in that the curvature of the suction surface-side boundary portion is smaller than the curvature of the pressure surface-side boundary portion, and that the contour of the boss on the suction side is noncircular when viewed in a projected manner along the rotation axis. When the radius of the suction surface-side boundary portion is changed abruptly, the air stream may generate the vortex without flowing along the blade shape. However, in the fifth embodiment, the radius Rs of the suction surface-side boundary portion 417*s* is changed as described above. With this, the air stream is promoted to flow along the blade shape to suppress the generation of the vortex.

Sixth Embodiment

Figure 10:
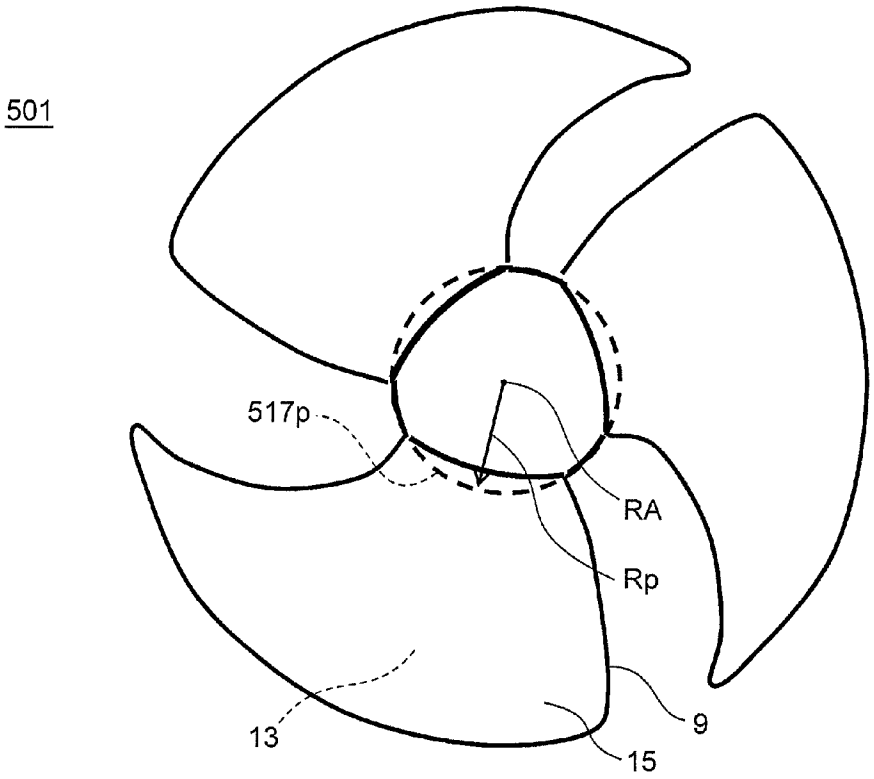
FIG. 10 is a view similar to FIG. 2, for illustrating a sixth embodiment of the present invention.

Next, a propeller fan according to a sixth embodiment of the present invention is described. FIG. 10 is a view similar to FIG. 2, for illustrating the sixth embodiment. Note that, except for the parts to be described below, the sixth embodiment is similar to the above-mentioned first embodiment.

A propeller fan 501 according to the sixth embodiment has a feature in that a radius Rp of a pressure surface-side boundary portion 517*p* has the same radius value over a region from the leading end portion to the trailing end portion of the pressure surface-side boundary portion 517*p*. Note that, the sixth embodiment is similar to the above-mentioned embodiments in that the curvature of the suction surface-side boundary portion is smaller than the curvature of the pressure surface-side boundary portion, and that the contour of the boss on the suction surface side is noncircular when viewed in a projected manner along the rotation axis. When the radius of the pressure surface-side boundary portion is increased midway between the leading end portion and the trailing end portion (that is, when a length of the trailing edge 9 of the blade is reduced), a blow-out region of the propeller fan on the radially inner side is decreased to reduce the air flow rate. In view of the above, in the sixth embodiment, the radius Rp of the pressure surface-side boundary portion 517*p* is constant so that the air flow rate is suppressed from being reduced. Further, with the configuration as described above, the high-efficient and low-noise effects described above can be achieved while maintaining the high air flow rate.

Note that, the sixth embodiment can be implemented in combination with any one of the above-mentioned second to sixth embodiments.

Seventh Embodiment

Figure 11:
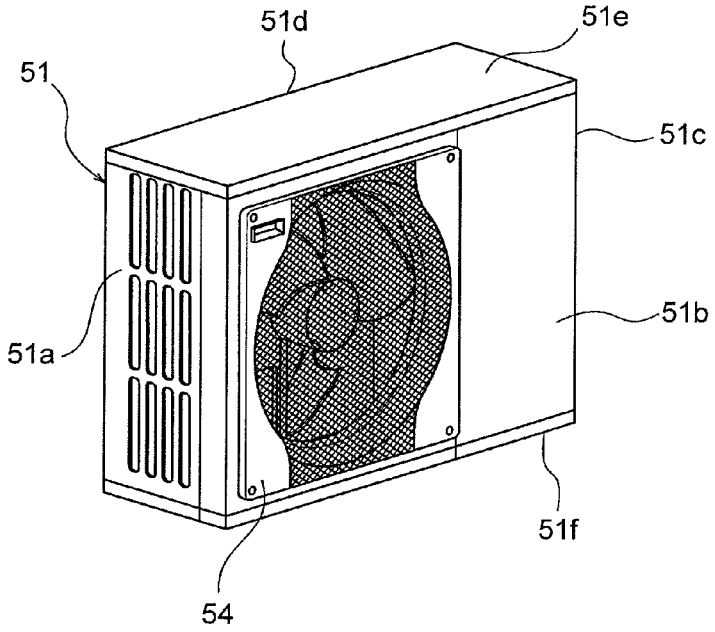
FIG. 11 is a perspective view for illustrating an outdoor unit according to a seventh embodiment of the present invention as viewed from an air outlet side thereof.
Figure 12:
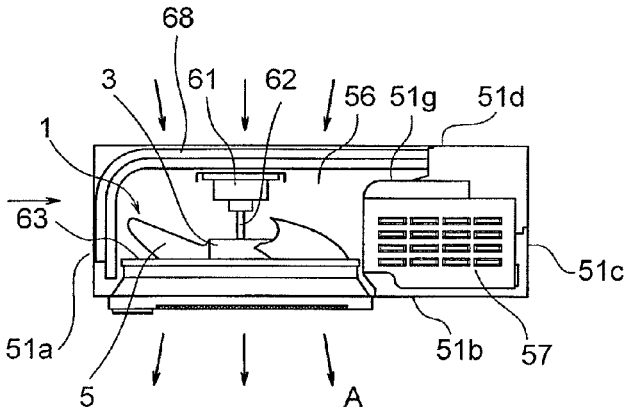
FIG. 12 is a view for illustrating a configuration of the outdoor unit according to the seventh embodiment as viewed from a top surface side thereof.
Figure 13:
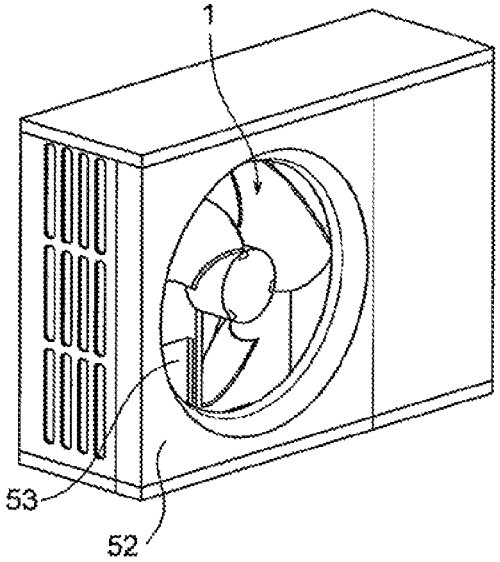
FIG. 13 is a view for illustrating a state in which a fan grille is removed according to the seventh embodiment.
Figure 14:
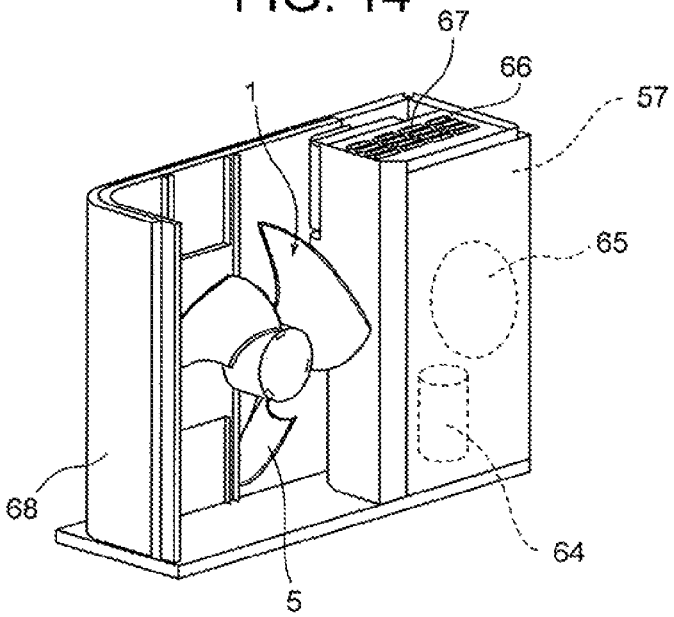
FIG. 14 is a view for illustrating an internal configuration in a state in which a front panel and the like are further removed according to the seventh embodiment.

Next, an outdoor unit (air blower) according to a seventh embodiment of the present invention is described. FIG. 11 is a perspective view for illustrating the outdoor unit (air blower) according to the seventh embodiment as viewed from an air outlet side thereof, and FIG. 12 is a view for illustrating a configuration of the outdoor unit as viewed from a top surface side thereof. Further, FIG. 13 illustrates a state in which a fan grille is removed, and FIG. 14 is a view for illustrating an internal configuration in a state in which a front panel and the like are further removed.

As illustrated in FIGS. 11 to 14, an outdoor-unit main body (casing) 51 is formed as a casing including a pair of right and left side surfaces 51*a* and 51*c*, a front surface 51*b*, a back surface 51*d*, a top surface 51*e*, and a bottom surface 51*f*. The side surface 51*a* and the back surface 51*d* each have an opening portion through which the air is sucked from an outside of the outdoor-unit main body (see the arrows A of FIG. 12). Further, in a front panel 52 of the front surface 51*b*, an air outlet 53 is formed as an opening portion through which the air is blown out to the outside (see the arrows A of FIG. 12). In addition, the air outlet 53 is covered with a fan grille 54. This configuration prevents contact between an object or the like and the propeller fan 1, to thereby assure safety.

The propeller fan 1 is mounted in the outdoor-unit main body 51. The propeller fan 1 is the propeller fan according to any one of the above-mentioned first to sixth embodiments. The propeller fan 1 is connected to a fan motor (driving source) 61 on the back surface 51*d* side through intermediation of a rotation shaft 62, and is rotated and driven by the fan motor 61.

An inside of the outdoor-unit main body 51 is partitioned by a partition plate (wall) 51*g* into an air-blowing chamber 56 in which the propeller fan 1 is housed and mounted, and a machine chamber 57 in which a compressor 64 and the like are mounted. On the side surface 51*a* side and the back surface 51*d* side in the air-blowing chamber 56, a heat exchanger 68 extending substantially in an L-shape in plan view is provided.

A bellmouth 63 is arranged on a radially outer side of the propeller fan 1 arranged in the air-blowing chamber 56. The bellmouth 63 is positioned on an outer side of the outer peripheral edge of each of the blades 5, and exhibits an annular shape along the rotating direction of the propeller fan 1. Further, the partition plate 51*g* is positioned on one side of the bellmouth 63 (on a right side in the drawing sheet of FIG. 12), and a part of the heat exchanger 68 is positioned on another side (opposite side) thereof (on a left side in the drawing sheet of FIG. 12).

A front end of the bellmouth 63 is connected to the front panel 52 of the outdoor unit so as to surround an outer periphery of the air outlet 53. Note that, the bellmouth 63 may be formed integrally with the front panel 52, or may be prepared as a separate component to be connected to the front panel 52. Due to the bellmouth 63, a flow passage between an air inlet side and an air outlet side of the bellmouth 63 is formed as an air passage in the vicinity of the air outlet 53. That is, the air passage in the vicinity of the air outlet 53 is partitioned by the bellmouth 63 from another space in the air-blowing chamber 56.

The heat exchanger 68 provided on the air inlet side of the propeller fan 1 includes a plurality of fins aligned side by side so that respective plate-like surfaces are parallel to each other, and heat-transfer pipes passing through the respective fins in an aligning direction of the fins. A refrigerant, which circulates through a refrigerant circuit, flows in the heat-transfer pipes. In the heat exchanger 68 according to this embodiment, the heat-transfer pipes extend in an L-shape along the side surface 51*a* and the back surface 51*d* of the outdoor-unit main body 51, and as illustrated in FIG. 14, the heat-transfer pipes in a plurality of tiers are constructed so as to pass through the fins in a zigzag manner. Further, the heat exchanger 68 is connected to the compressor 64 through piping 65 or the like. In addition, the heat exchanger 68 is connected to an indoor-side heat exchanger, an expansion valve, and the like (not shown) so as to form a refrigerant circuit of an air conditioner. Further, a board box 66 is arranged in the machine chamber 57. Devices mounted in the outdoor unit are controlled by a control board 67 provided in the board box 66.

Also in the seventh embodiment, the same advantage as that of each of the above-mentioned corresponding first to sixth embodiments can be obtained. Further, when the propeller fan of one of the above-mentioned first to sixth embodiments is mounted to the air blower, a flow rate of the air to be blown can be increased with high efficiency. Further, when the propeller fan of one of the above-mentioned first to sixth embodiments is mounted to the outdoor unit of the air conditioner, which serves as a refrigeration cycle system including the compressor, the heat exchanger, and the like, or to the outdoor unit of a hot-water supply device, the flow rate of the air to pass through the heat exchanger can be secured with low noise and high efficiency. With this, the low noise and high energy efficiency of the devices can be achieved.

Note that, in the seventh embodiment, the outdoor unit of the air conditioner is exemplified as an outdoor unit including an airblower. However, the present invention is not limited thereto, but can be implemented as, for example, an outdoor unit of a hot-water supply device or the like. In addition, the present invention can be widely employed as an apparatus for blowing the air, and can be applied to an apparatus, equipment, and the like other than the outdoor unit.

Although the details of the present invention are specifically described above with reference to the preferred embodiments, it is apparent that persons skilled in the art may adopt various modifications based on the basic technical concepts and teachings of the present invention.

REFERENCE SIGNS LIST

1, 101, 201, 301, 401, 501 propeller fan, 3 boss, 5 blade, 13 pressure surface, 15 suction surface, 17 boundary portion, 17*p*, 117*p*, 317*p*, 517*p* pressure surface-side boundary portion, 17*s*, 117*s*, 217*s*, 317*s*, 417*s* suction surface-side boundary portion

The invention claimed is:

1. A propeller fan, comprising:

a boss that is rotatable about a rotation axis; and a plurality of blades formed along a side surface of the boss, each of the plurality of blades comprising a concave leading edge, a pressure surface and a suction surface, wherein:

when a connecting portion between the pressure surface of the each of the blades and the side surface of the boss is defined as a pressure surface-side boundary portion, and a connecting portion between the suction surface of the each of the blades and the side surface of the boss is defined as a suction surface-side boundary portion, a curvature of the suction surface-side boundary portion is smaller than a curvature of the pressure surface-side boundary portion; and as a blade area projected on a plane orthogonal to the rotation axis, a blade area of the suction surface is larger than a blade area of the pressure surface.

2. The propeller fan according to claim 1, wherein a radius of a leading end portion of the suction surface-side boundary portion is smaller than a radius of a leading end portion of the pressure surface-side boundary portion.

3. The propeller fan according to claim 1, wherein a radius of the suction surface-side boundary portion is enlarged smoothly as being shifted from a leading end portion to a trailing end portion of the suction surface-side boundary portion.

4. The propeller fan according to claim 1, wherein the pressure surface-side boundary portion has the same radius value over a region from a leading end portion to a trailing end portion of the pressure surface-side boundary portion.

5. An air blower, comprising:

the propeller fan of claim 1;

a driving source for applying a driving force to the propeller fan; and a casing in which the propeller fan and the driving source are housed.

6. An outdoor unit, comprising:

a heat exchanger;

the propeller fan of claim 1;

a driving source for applying a driving force to the propeller fan; and a casing in which the propeller fan, the driving source, and the heat exchanger are housed.

7. A propeller fan, comprising:

a boss that is rotatable about a rotation axis; and a plurality of blades formed along a side surface of the boss, each of the plurality of blades comprising a pressure surface and a suction surface, wherein:

when a connecting portion between the pressure surface of the each of the blades and the side surface of the boss is defined as a pressure surface-side boundary portion, and a connecting portion between the suction surface of the each of the blades and the side surface of the boss is defined as a suction surface-side boundary portion, a curvature of the suction surface-side boundary portion is smaller than a curvature of the pressure surface-side boundary portion; and as a blade area projected on a plane orthogonal to the rotation axis, a blade area of the suction surface is larger than a blade area of the pressure surface, wherein a radius of a trailing end portion of the suction surface-side boundary portion is larger than a radius of a leading end portion of the suction surface-side boundary portion.

8. A propeller fan, comprising:

a boss that is rotatable about a rotation axis; and a plurality of blades formed along a side surface of the boss, each of the plurality of blades comprising a pressure surface and a suction surface, wherein:

when a connecting portion between the pressure surface of the each of the blades and the side surface of the boss is defined as a pressure surface-side boundary portion, and a connecting portion between the suction surface of the each of the blades and the side surface of the boss is defined as a suction surface-side boundary portion, a curvature of the suction surface-side boundary portion is smaller than a curvature of the pressure surface-side boundary portion; and as a blade area projected on a plane orthogonal to the rotation axis, a blade area of the suction surface is larger than a blade area of the pressure surface, wherein a radius of a trailing end portion of the suction surface-side boundary portion is equal to a radius of a trailing end portion of the pressure surface-side boundary portion.

* * * * *